US005964233A

United States Patent [19]

Clark et al.

[11] Patent Number: 5,964,233

[45] Date of Patent: Oct. 12, 1999

[54] PATIO UMBRELLA WITH RADIANT HEATER

[76] Inventors: Walter B Clark, 2255 Stenner Creek Rd., San Luis Obispo, Calif. 93405; M. Robert Davis, 1855 San Luis Dr., San Luis Obispo, Calif. 93401

[21] Appl. No.: 09/133,098

[22] Filed: Aug. 12, 1998

[51] Int. Cl.[6] ..... A45B 3/00; E04H 15/12

[52] U.S. Cl. ..... 135/16; 135/33.6; 135/91; 135/92

[58] Field of Search ..... 135/15.1, 16, 33.6, 135/48, 91, 92, 94

[56] References Cited

U.S. PATENT DOCUMENTS

| | | | |
|---|---|---|---|
| 3,444,799 | 5/1969 | Covington | 135/16 |
| 3,739,792 | 6/1973 | Holland | 135/16 |
| 4,505,285 | 3/1985 | French | 135/16 X |
| 4,844,108 | 7/1989 | Rohrer | 135/91 |
| 5,115,827 | 5/1992 | Lee | 135/33.7 |
| 5,207,238 | 5/1993 | Rivera et al. | 135/16 |
| 5,273,062 | 12/1993 | Mozdzanowski | 135/16 |

*Primary Examiner*—Carl D. Friedman
*Assistant Examiner*—Timothy B. Kong
*Attorney, Agent, or Firm*—Daniel C. McKown

[57] ABSTRACT

A patio umbrella that includes a dining table and a fuel-burning radiant heater avoids overheating of the upper canopy by mounting the support on which the upper canopy rests in the shadow cast by a reflector that converges upwardly to a chimney portion. The reflector is affixed to the housing of the combustion chamber. In addition to reflecting radiant heat downwardly onto the table and the diners, the reflector shields the upper canopy support from radiant heat and provides a duct for venting the products of combustion. As the latter pass up through the chimney portion, cooler air is drawn up through the space between the reflector and the upper canopy support thereby preventing hot air from stagnating there. The upper canopy support is mounted to the reflector and spaced above it by a number of insulative ceramic spacers. Brackets affixed to the reflector extend outwardly of the pivotal attachment of the ribs of the umbrella, thereby permitting the ribs to clear the combustion chamber and at the same time shortening the ribs so that when the umbrella is closed the lower ends of the ribs are well above the table top so as not to intrude into the space used for serving food. A safety switch, mounted within the column that supports the heater, extinguishes the heater as the umbrella is closed.

5 Claims, 4 Drawing Sheets

PATIO UMBRELLA WITH RADIANT HEATER

BACKGROUND OF THE INVENTION

1. Field of the Invention

The present invention is a patio umbrella that includes a fuel-burning radiant heater and a dining table.

It frequently happens that outdoor temperature ranges from comfortably warm at mid-day to chilly in the evenings. The comfortable mid-day temperatures are an incentive for restaurant owners to provide facilities for outdoor patio dining. However, construction of such facilities is predicated on their efficient use, which is somewhat marginal unless steps are taken to insure the comfort of the customers throughout a substantial portion of the entire day, including the cooler hours.

To this end, outdoor patios are often provided with radiant heaters that burn natural gas or propane gas. Heaters of this type are available from a number of manufacturers. A typical heater of this type is approximately 93 inches tall. The combustion chamber is supported by a hollow column that extends upward from the floor, and a reflector in the shape of an inverted dish is located above the combustion chamber for the purpose of reflecting radiant heat downward that would otherwise travel skyward.

Ordinarily, when radiant heaters are installed on a patio, they are placed between the tables where they become an obstacle for the service employees and for the customers alike. To provide adequate space for passage around the heaters, the tables must be more widely spaced, thereby rendering the patio less efficient.

Because the outdoor daytime temperature may be quite warm and because the patio may be subjected to direct sunshine, it is desirable to protect the customers from the direct sunshine by providing a large umbrella, often called a beach umbrella or patio umbrella. Such umbrellas typically measure 6 to 8 feet across, and they are not generally practical where high wind speeds prevail.

The present invention is one solution to the many problems that must be considered in combining a radiant heater with a large umbrella. It does not appear that such a combination has successfully been made prior to the present invention.

2. The Prior Art

In U.S. Pat. No. 3,295,473 issued Jan. 3, 1967, Wentworth describes a table mounted on the vertical shaft of a large umbrella, but there is no heater. Likewise, in U.S. Pat. No. 3,624,732 issued Nov. 30, 1971, Bowden also shows a vertically-adjustable table mounted on the vertical shaft of a large umbrella. Again, no suggestion of supplying heat is given.

In U.S. Pat. No. 3,739,972 issued Jun. 19, 1973, Holland describes a hand-carried rain umbrella in which the ribs of the umbrella incorporate electric heating elements that are operated by batteries within the shaft of the umbrella. Because this umbrella does not use a heater in which combustion occurs, the problems inherent in this umbrella are different from those encountered in the present invention.

In U.S. Pat. No. 3,625,235 issued Dec. 7, 1971 to Gorgichuk, there is shown a spherical shelter in which a stove sits on the floor, and a stovepipe extends vertically upward and through a hole at the top of the structure. Likewise, in U.S. Pat. No. 4,844,108 issued Jul. 4, 1989, Rohrer shows a tent containing a stove. The stove is located near the floor, and the tent is supported by a hollow vertical central column that serves as a chimney for the stove. A similar arrangement is shown in U.S. Pat. No. 2,601,865 issued Jul. 1, 1952 to Campbell.

In the patents of Gorgichuk, of Rohrer, and of Campbell, the stove is located on the ground or floor, and the top part of the stovepipe, which is nearest the tent, is far enough from the stove that the temperature of the top of the stovepipe is no great concern.

The following four patents show designs for poultry brooders: U.S. Pat. No. 1,584,877 issued May 18, 1926 to McCorkle; U.S. Pat. No. 2,985,137 issued May 23, 1961 to Horne; U.S. Pat. No. 3,349,752 issued Oct. 31, 1967; and, U.S. Pat. No. 4,614,166 issued Sep. 30, 1986 to Maurice. These patents show the use of a metal hood to reflect radiant heat downward onto the chicks. These patents do not show a cloth umbrella that can be opened and closed at will, and they do not suggest how the structure of such an umbrella can be integrated into the structure of the poultry brooder. Chicks in a brooder appear to have little interest in coming into contact with the hot metal parts of the brooder; however, humans on a restaurant patio can be expected to handle various parts of the umbrella frame. This is a problem not faced by brooder designers.

As the present inventors set out to combine an outdoor radiant combustion heater with a patio type umbrella for use in a restaurant environment, they were immediately faced by a number of severe problems.

The most obvious problem confronting the inventors was how to prevent the cloth canopy of the umbrella from overheating and either scorching or burning. In the preferred embodiment, the canopy of the umbrella is composed of a heavy fire-resistant canvas-like cloth, which nonetheless is susceptible to heat damage if subjected to a sufficiently high temperature.

Equally serious however was the problem of preventing the metallic umbrella frame structure from overheating and burning the hands of curious patrons. Also, a way had to be found to prevent the umbrella from being closed while the burner is still in operation.

A severe mechanical problem arose from the fact that the combustion chamber of the heater needed to occupy the space normally occupied by the hub of the umbrella.

Still other problems involved the flow of air. It was desired to retain the vent opening between the upper and lower canopies, which enables the umbrella to withstand stronger winds. Also, it was not apparent how to provide a supply of fresh air to the burner and to dispose of the hot products of combustion.

The present invention solves all of the aforementioned problems and the final product is safe and reliable.

BRIEF SUMMARY OF THE INVENTION

In accordance with a preferred embodiment of the present invention, a multi-element structure solves the mechanical problems, the thermal problems, and the air flow problems that are faced when one tries to integrate an infrared radiation combustion heater with a large flammable cloth umbrella. The heater includes a base from which a hollow steel column extends vertically. The vertical column encloses a fuel line and is surmounted by a housing that encloses a combustion chamber. Heaters of this type are widely available commercially. As supplied by the manufacturer, a small reflector, shaped like an inverted dish, rests directly on the top of the combustion chamber housing.

The present invention also employs a reflector, but it is supported above the heater housing on several legs that space the reflector from the heater housing. The reflector of the present invention converges upwardly to an opening to promote an upward flow of air through the space between the reflector and the heater housing so as to dispose of the hot products of combustion. In contrast, in the conventional heater, where no umbrella cloth is involved, there is a tendency for the hot products of combustion to be retained under the reflector.

A frusto-pyramidal upper canopy support, formed of sheet metal, supports the upper canopy and imparts a pyramidal shape to it. The sheet metal upper canopy support is located above the reflector and is spaced from the reflector by insulative ceramic spacers, which greatly reduce the flow of heat from the reflector to the upper canopy support. Also, the space between the upper canopy support and the reflector provides a passage through which heated air may rise to a central opening. The rising hot products of combustion tend to draw air upwardly through this passage, whereby air that has become heated by the reflector and the heater housing is discharged and continually replaced by a stream of cooler air. In this way, the sheet metal upper canopy support is kept cool by three techniques, as follows. First, the upper canopy support lies in the shadow cast by the reflector and therefore the radiant heat falling on it is greatly reduced. Secondly, conduction of heat from the reflector to the upper canopy support is greatly reduced by the insulative ceramic spacers. Thirdly, an upwardly rising stream of cool air tends to cool the upper canopy support. These three effects work together to keep the upper canopy support at a sufficiently low temperature that there is no danger of scorching the upper canopy which lies on the upper surface of the upper canopy support.

The mechanical problems involved in integrating a combustion heater into a large cloth umbrella are formidable. Most umbrellas have a number of ribs that converge to pivot points that are located on a central hub. Unfortunately, for symmetry, the combustion chamber needs to be located in the space normally occupied by the central hub of the umbrella. Also, it initially appeared that the presence of the reflector would prevent the closing of the umbrella.

The present inventors solved this problem by abandoning the central hub and by pivotally attaching the upper ends of the ribs of the umbrella to brackets attached to and extending outward from the reflector. Only the lower canopy portion of the umbrella opens and closes. The upper canopy retains its pyramidal shape as the umbrella is closed.

Because the heated umbrella of the present invention is intended for use on patios and restaurant dining areas where many people, including children, may be present, it is not sufficient that it be designed so that the cloth canopy does not burst into flames. It is also necessary that those parts of the structure that can be reached by the people must be maintained at a safe temperature—that is, a temperature that will permit the reachable portions to be touched safely. This criterion has been met by the design of the present invention, which safely integrates a fuel-burning heater into a cloth umbrella.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE INVENTION

Figure 1:
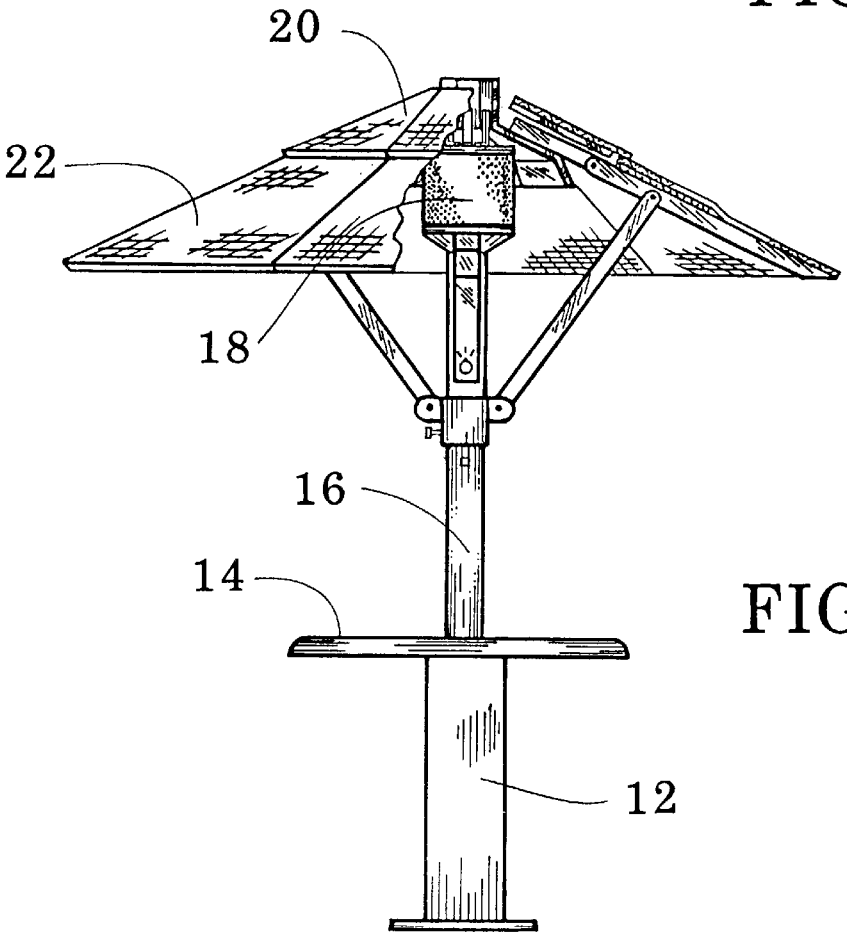
FIG. 1 is a front elevational view of a preferred embodiment of the deck umbrella with radiant heater of the present invention, partially cut away to show the internal structure.

FIG. 1 shows the main parts of the patio umbrella in a preferred embodiment. In that embodiment, the umbrella is approximately eight feet in diameter and approximately nine feet high. The umbrella includes a base 12. In the preferred embodiment, plumbing for natural gas is brought into the base from beneath the floor. In another embodiment, the base contains a tank of fuel, such as butane or propane, which permits the entire unit to be portable. The base 12 supports a table top 14, used for dining. A hollow steel column 16 extends vertically out of the base, through the table top, and upward to support a combustion chamber 18. The hollow column 16 encloses a fuel line through which the fuel is brought to the combustion chamber.

Figure 5:
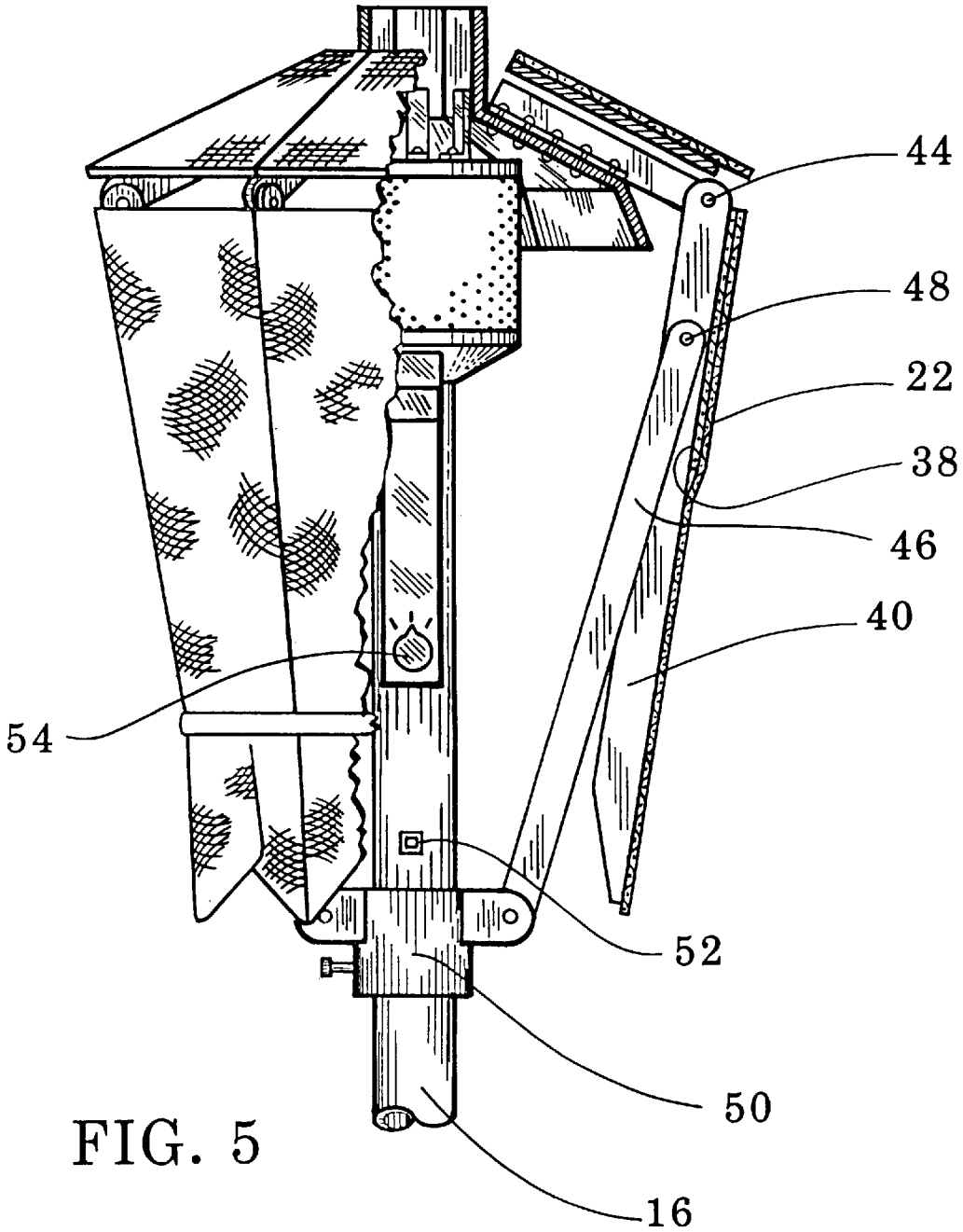

The umbrella is shown in its open configuration in FIG. 1, and FIG. 5 shows it in the closed configuration. The canopy of the umbrella includes an upper centrally located canopy 20 and a lower canopy 22 that surrounds the upper canopy 20. The lower edge of the upper canopy slightly overlaps the upper edge of the lower canopy to facilitate runoff of moisture, but a vent opening is maintained between the upper canopy and the lower canopy to relieve air pressure differences which winds may cause.

Figure 2:
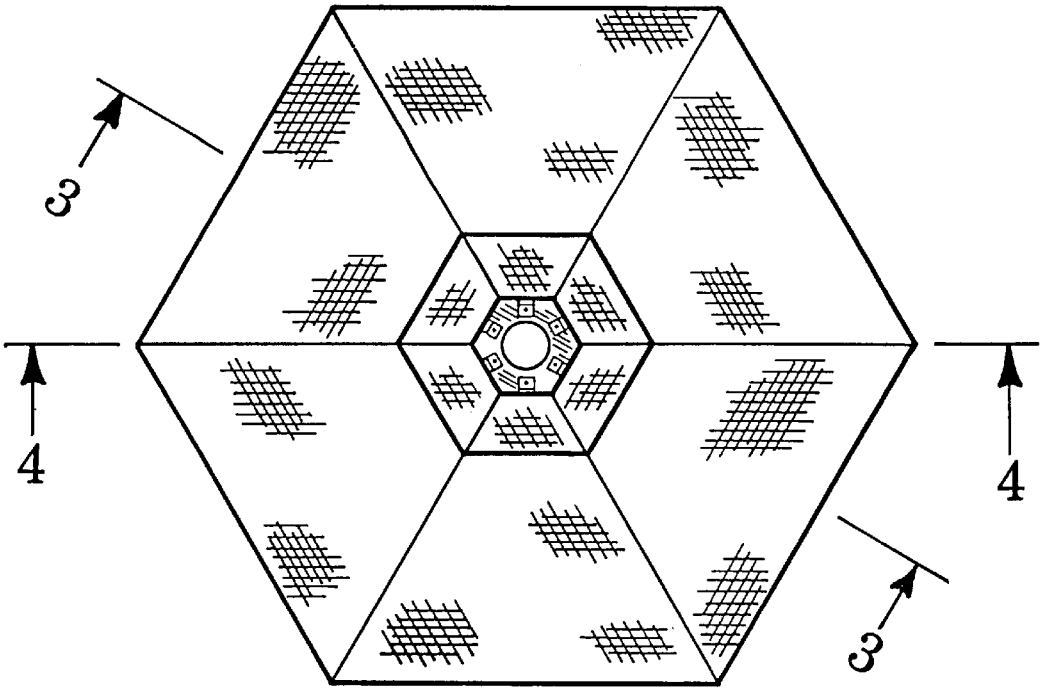
FIG. 2 is a top plan view of the embodiment of FIG. 1.
Figure 3:
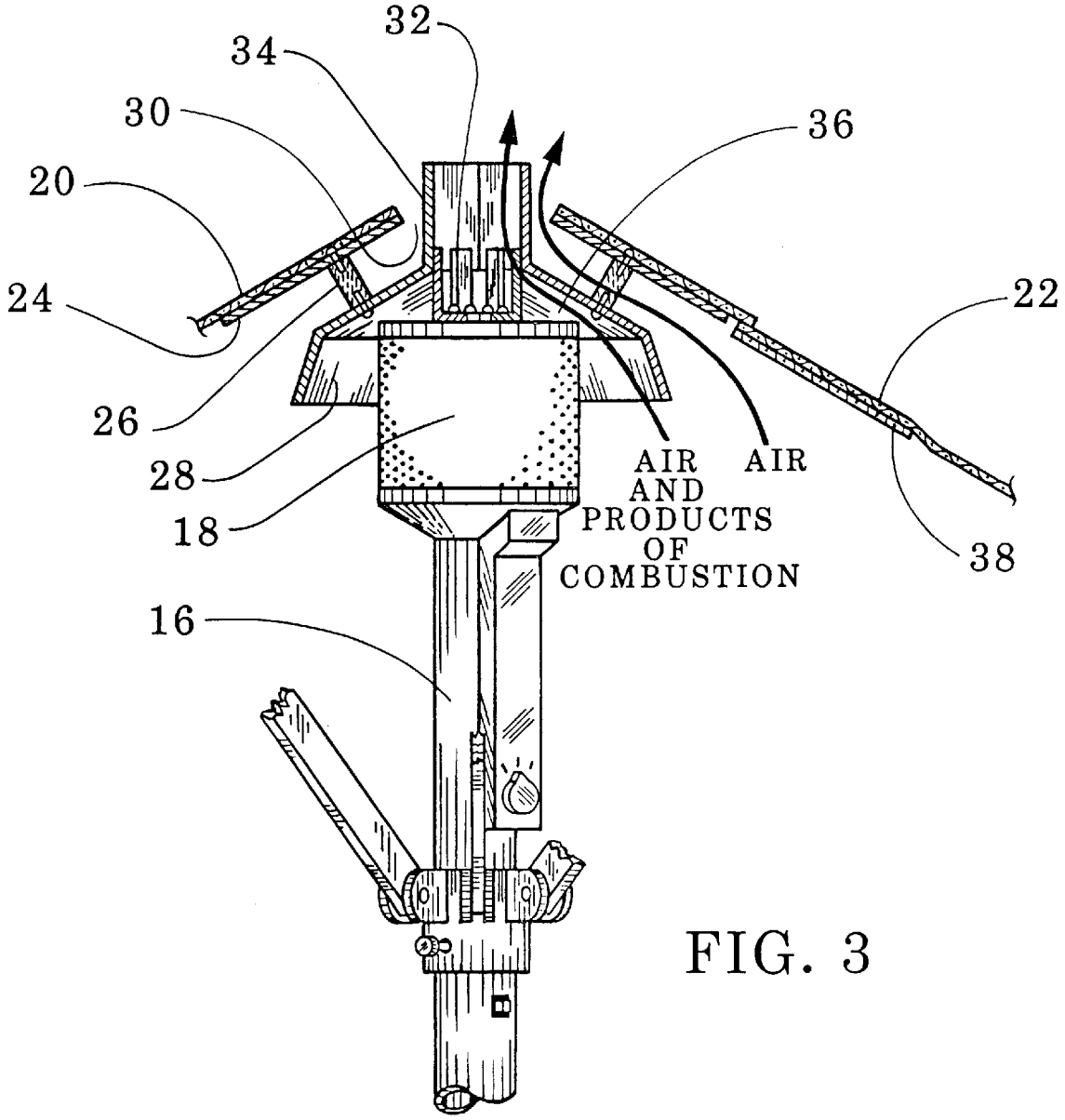
FIG. 3 is a fractional elevational cross sectional view of the embodiment of FIG. 1 taken in the direction 3—3 indicated in FIG. 2.
Figure 4:
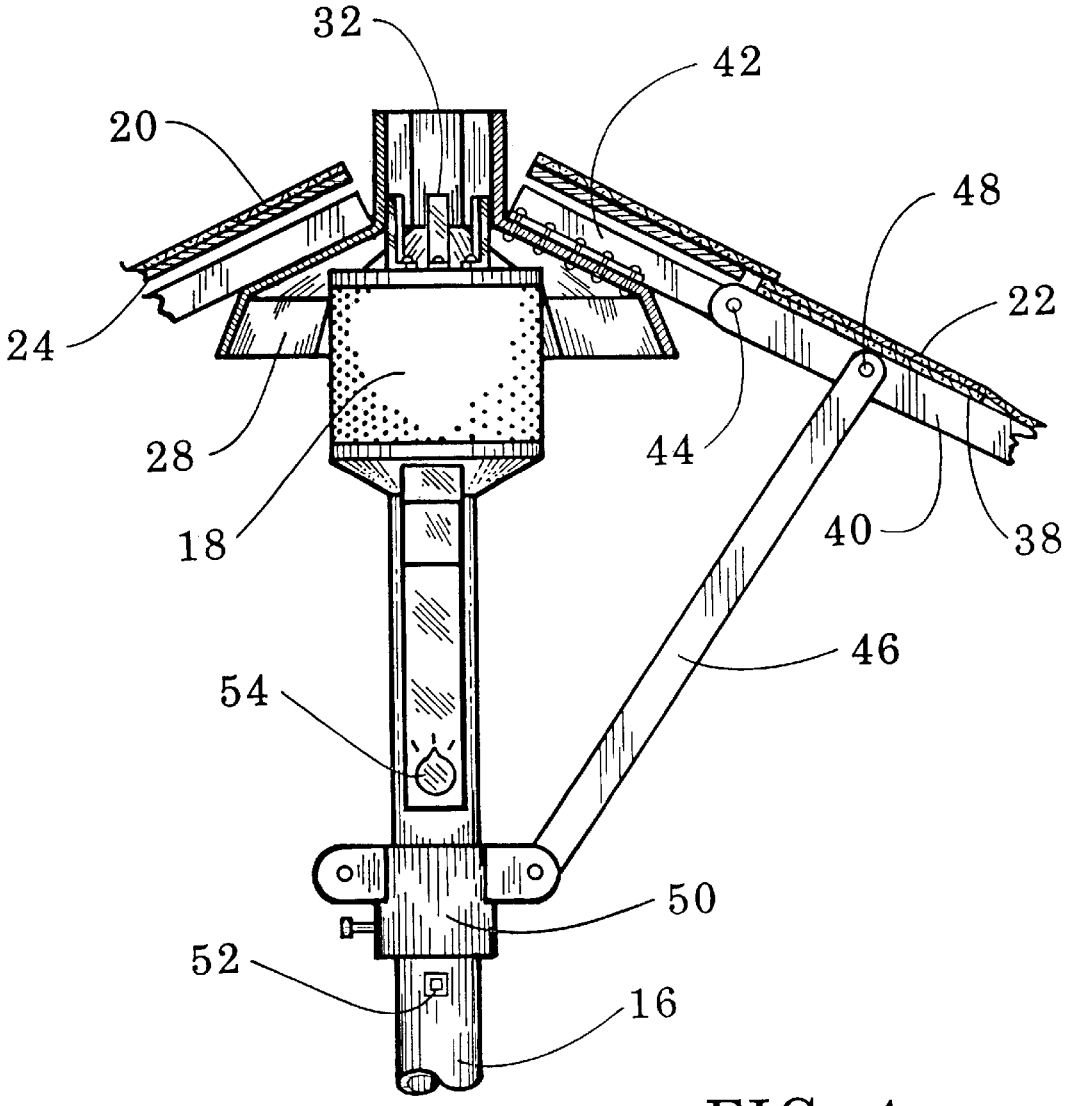
FIG. 4 is a fractional front elevational cross sectional view of the embodiment of FIG. 1 taken in the direction 4—4 indicated in FIG. 2; and, FIG. 5 is a fractional front elevational cross sectional view of the embodiment of FIG. 1 showing the umbrella in the closed configuration and partially cut away to show the internal structure.

FIG. 2 is a top view of the umbrella of FIG. 1 and shows the directions in which the views of FIGS. 3 and 4 are taken.

As seen in FIG. 3, the upper canopy 20 lies on top of and is supported by the upper canopy support 24. As suggested by FIG. 2, the upper canopy support is a sheet metal structure having a frusto-pyramidal shape and formed from six identical four-sided sections that are joined along their lateral edges. The upper canopy support 24 is affixed to the reflector 28 by six insulative spacers, of which the spacer 26 is typical. Not only do the spacers 26 support the upper canopy support 24, but in addition, they maintain a space 30 between the upper canopy support 24 and the reflector 28, while at the same time defeating conduction of heat from the reflector 28 to the upper canopy support 24. The space between the upper edge of the upper canopy support and the reflector is important to permit the upward discharge of air that has become heated and flows upwardly through the space 30. This upward flow helps to prevent convective heating of the upper canopy support 24, thereby helping to keep the upper canopy cool.

The reflector 28 is a hollow sheet metal structure which surrounds the upper portion of the combustion chamber 18, much like a lampshade surrounds an electric light bulb. The reflector 28 is connected the combustion chamber 18 by six legs, of which the leg 32 is typical. The legs 32 maintain a spacing between the reflector 28 and the combustion chamber 18, and cooler air is drawn upward through that space 36 helping to cool the reflector 28. Because the legs 32 are closer to the combustion chamber 18 and farther from the upper canopy, there was no advantage in making the legs of an insulative material.

FIG. 3 is convenient to illustrate some of the techniques by which the present inventors addressed the thermal problems that could result from combining a combustion heater with a cloth umbrella.

Conduction of heat is minimized by making the cross section of the legs 32 (perpendicular to the direction of heat flow) as small as possible consistent with the mechanical loads that the legs must support. Conduction between the reflector 28 and the upper canopy support 24 is minimized by the use of the insulative spacers 26. In the preferred embodiment, the spacers 26 are composed of a ceramic material, and they include blind threaded holes at either end to avoid any metallic conduction path between the reflector 28 and the upper canopy support 24. In these ways the conduction of heat between the combustion chamber 18 and the upper canopy support 24 is minimized by the present invention.

Radiative transfer is minimized by placing the upper canopy support 24 in the shadow of the reflector 28. The reflector 28 disposes of a significant part of the radiation from the combustion chamber 18 by reflecting the radiation downward toward the space surrounding the table top 14, where the radiation imparts a comfortable warmth to persons sitting there. The under side of the upper canopy support 24 also reflects radiant heat, thereby further helping to keep the upper canopy cool.

A third way in which inventors addressed the thermal problems was by an ingenious use of convection. The hot products of combustion are discharged from the side of the combustion chamber 18, and they rise through the chimney portion 34 of the reflector 28. In doing so, they create an updraft in the space 36 between the combustion chamber 18 and the reflector 28. Were it not for this space 36, the air would be trapped between the combustion chamber and the reflector 28 and this air would become heated to a very high temperature, thereby causing the reflector to become much hotter than it does in the present design. Similarly, by not connecting the upper canopy support to the chimney portion 34 of the reflector, the present inventors made it possible for hot air to be discharged upwardly along the chimney portion 34, as indicated by the arrows in FIG. 3. As the hot air is discharged upwardly, it is replaced by cooler upwardly-flowing air. Again, this helps to keep the upper canopy support 24 at an acceptable temperature.

Although protection of the upper canopy was more critical, because of its closeness to the combustion chamber and its position above the combustion chamber, protection of the lower canopy was also necessary. Unlike the upper canopy which is supported on the upper canopy support 24, the lower canopy simply spans the space between the ribs of the umbrella. The lower canopy must remain pliable so that the umbrella can be closed. Even though the lower canopy is farther from the combustion chamber than the upper canopy is, the present inventors found that the upper portion of the lower canopy required protection from heat damage. As best seen in FIG. 4, they accomplished this by lining the upper portion of the lower canopy, on the side facing the combustion chamber, with a layer 38 of aluminized reflective fire-resistant fabric. This fabric, which has a silvery metallic appearance was originally developed for use in the space program. It combines high reflectivity (on the order of 90 per cent) with pliability and durability. The inventors found that the reflection caused by the lining 38 was sufficient to prevent overheating of the lower canopy. Radiative transfer of heat to the lower canopy is the only significant mode of heat transfer; the distances and disposition of the structure are such that convective and conductive modes are not significant. In addition to protecting the lower canopy from overheating, the reflective lining 38 also reflects radiant heat downward onto the table top and diners.

The lining 38 also serves to protect the lower canopy 22 in the event the umbrella is closed while the combustion chamber 18 is hot; for example, if the umbrella is closed immediately after the burner has been extinguished, before the combustion chamber has had time to cool.

As seen in FIG. 2, FIG. 4 is a cross sectional view taken in the plane of one of the ribs 40 of the umbrella. While FIG. 3 was useful in discussing the thermal aspects of the invention, FIG. 4 is more useful in illustrating how the present inventors solved the mechanical problems inherent in integrating a combustive heater with an umbrella.

The presence of the combustion chamber 18 and its associated reflector 28 presented the critical problems of: where to attach the upper ends of the ribs; and, how to permit the umbrella to be closed without the ribs interfering with the reflector 28.

The present inventors solved this problem by affixing six brackets, of which the bracket 42 is typical, to the reflector 28. The brackets are riveted to the reflector and extend outwardly and downwardly parallel to the ridge lines of the canopy. The upper end of the rib 40 is attached to the lower end of the bracket 42 by the pin 44, which permits the rib 40 to pivot up and down as the umbrella is opened and closed. The pin 44 is located further from the center of the umbrella than the reflector 28, and therefore the reflector does not interfere mechanically with the rib. The rib 40 is supported in the open position by the arm 46, which is pivotally attached to the rib 40 by the pin 48. The lower end of the arm 46 is pivotally attached to a sleeve 50 that slides up and down on the column 16. The use of a sliding sleeve and a support arm pivotally connected to the rib are recognized as old. The innovation of the present inventors was in attaching the top end of the rib to a stationary bracket affixed to the reflector 28 and in extending the pivot point 44 for the rib outward beyond the reflector. In this way, the reflector does not interfere with the ribs, even when the umbrella is in its closed configuration, as shown in FIG. 5.

This technique of mounting the ribs produced another advantage. Even when the umbrella is in the folded configuration of FIG. 5, the canopy does not extend downwardly far enough to intrude into the space between the persons seated around the table top 14, and thus does not block their view or interfere with the serving of food. In the preferred embodiment, when the umbrella is in the closed configuration, the lower edge of the canopy remains about two feet above the table top 14.

It is evident from FIG. 4, that much of the weight of the canopy and ribs is diverted through the arm 46 to the sleeve 50. Accordingly, the legs 32 are not required to support the entire weight of the canopy and ribs. This is what permits the legs to have a relatively small cross sectional area. Also, because of the symmetry of the umbrella, static lateral loads on the legs 32 are relatively small.

Also visible in FIG. 5 is the actuator arm 52 of a microswitch. The actuator arm extends through the wall of the hollow column 16 and is actuated by the sleeve 50 as the sleeve passes over it. The microswitch, located within the hollow column 16, is turned on by upward passage of the sleeve 50 over the actuator 52 and the microswitch is turned off by downward passage of the sleeve 50 over the actuator 52. The microswitch is connected to the fuel valve in such a way that closing of the umbrella extinguishes the combustion, which remains disabled until the microswitch is again actuated by upward passage of the sleeve 50 as the umbrella is again opened.

The controls of the heater have been simplified. In addition to the aforesaid safety feature, the only other control is a knob 54 that is connected to a timer. Combustion is possible only when the timer is counting down. Thus, when the diners are first seated, the waiter can initiate combustion by turning the knob 54. No further attention is required, because when the timer has run out, the combustion ceases. This energy-saving feature has proven to be highly convenient; it is not necessary to remember to turn the heater off.

In practice, the measures taken by the inventors to solve the thermal and mechanical problems inherent in integrating the combustion heater with the cloth umbrella have proven to be quite successful. The hottest reachable portion of the arm 46 is warm to the touch, but definitely not hot enough to cause a burn when touched.

Thus, there has been described the successful integration of a fuel-burning radiant heater into a patio umbrella having a cloth canopy. This increases the time during which patio dining may be enjoyed, because the heaters can be used when the weather is cool, and the umbrellas can be used for protection against the sun. The combination is superior to having separate umbrellas and heaters, because in the latter case the heaters take up valuable floor space and impede the flow of foot traffic.

The foregoing detailed description is illustrative of a preferred embodiment of the invention, and it is to be understood that additional embodiments thereof will be obvious to those skilled in the art. The embodiment described herein together with those additional embodiments are considered to be within the scope of the invention.

What is claimed is:

1. A patio umbrella capable of providing radiant heating in its vicinity, comprising in combination:

a fuel-burning radiant heater having a base, having a hollow column extending upward from said base, having a table top above said base and surrounding said hollow column, and having a combustion chamber attached to the top of said hollow column;

a reflector converging upwardly to a chimney portion;

means for supporting said reflector above and spaced from said combustion chamber so that hot products of combustion arising from said combustion chamber will pass upward through the chimney portion of said reflector thereby drawing cool air upward through the space between said combustion chamber and said reflector, whereby said reflector is cooled;

an upper canopy support converging upwardly from a lower edge to an aperture that surrounds and is spaced from the chimney portion of said reflector;

insulative means for supporting said upper canopy support in the shadow cast by said reflector in radiant energy emitted by said heater, above and spaced from said reflector so that air that has become heated in the space between said reflector and said upper canopy support can pass upward through that space and escape upward between said upper canopy support and the chimney portion of said reflector thereby drawing cool air upward into the space, whereby said upper canopy support is cooled.

2. The patio umbrella of claim 1 further comprising a lower canopy extending downward and outward from the lower edge of the upper canopy support, and further comprising a lining on the inner side of said lower canopy, said lining composed of a reflective pliable material for reflecting radiant energy emitted by said heater away from said lower canopy, whereby overheating of said lower canopy is prevented.

3. A patio umbrella capable of providing radiant heating in its vicinity, comprising in combination:

a fuel-burning radiant heater having a base, having a hollow column extending upward from said base, having a table top above said base and surrounding said hollow column, and having a combustion chamber attached to the top of said hollow column;

a reflector converging upwardly to a chimney portion;

means for supporting said reflector above and spaced from said combustion chamber;

a bracket attached to said reflector and having a portion that extends outward beyond said reflector;

a rib extending downward and outward;

rib pivot means for pivotally attaching said rib to said bracket, said rib pivot means located outward beyond said reflector so that as said rib pivots from an open position to a closed position it does not interfere with said reflector.

4. The patio umbrella of claim 3 further comprising:

a sleeve surrounding said hollow column and slidable along said hollow column from a lowest position occupied when the patio umbrella is in a closed configuration to a highest position occupied when the patio umbrella is in a fully-opened configuration;

said hollow column including portions defining a hole so located vertically that the hole is alternately covered and uncovered by said sleeve as said sleeve is raised and lowered between its lowest and highest positions;

an arm having an upper end pivotally attached to said rib and having a lower end pivotally attached to said sleeve;

an electrical switch located within said hollow column and including an actuator arm that extends outward through the hole in said hollow column so that passage of said sleeve over said actuator arm actuates said electrical switch.

5. A patio umbrella capable of providing radiant heating in its vicinity, comprising in combination:

a fuel-burning radiant heater having a base, having a hollow column extending upward from said base, having a table top above said base and surrounding said hollow column, and having a combustion chamber attached to the top of said hollow column;

a reflector converging upwardly to a chimney portion;

means for supporting said reflector above and spaced from said combustion chamber so that hot products of combustion arising from said combustion chamber will pass upward through the chimney portion of said reflector thereby drawing cool air upward through the space between said combustion chamber and said reflector, whereby said reflector is cooled;

an upper canopy support converging upwardly from a lower edge to an aperture that surrounds and is spaced from the chimney portion of said reflector;

insulative means for supporting said upper canopy support in the shadow cast by said reflector in radiant energy emitted by said heater, above and spaced from said reflector so that air that has become heated in the space between said reflector and said upper canopy support can pass upward through that space and escape upward between said upper canopy support and the chimney portion of said reflector thereby drawing cool air upward into the space, whereby said upper canopy support is cooled;

a bracket attached to said reflector and having a portion that extends outward beyond said reflector;

a rib extending downward and outward; and, rib pivot means for pivotally attaching said rib to said bracket, said rib pivot means located outward beyond said reflector so that as said rib pivots from an open position to a closed position it does not interfere with said reflector.

* * * * *